US009121658B1

(12) United States Patent
Darlington

(10) Patent No.: US 9,121,658 B1
(45) Date of Patent: Sep. 1, 2015

(54) COMPOUND ARCHERY BOW WITH SYNCHRONIZED CAMS AND DRAW STOP

(71) Applicant: Rex F. Darlington, Whittemore, MI (US)

(72) Inventor: Rex F. Darlington, Whittemore, MI (US)

( * ) Notice: Subject to any disclaimer, the term of this patent is extended or adjusted under 35 U.S.C. 154(b) by 0 days.

(21) Appl. No.: 14/231,872

(22) Filed: Apr. 1, 2014

Related U.S. Application Data

(60) Provisional application No. 61/865,473, filed on Aug. 13, 2013.

(51) Int. Cl.
*F41B 5/10* (2006.01)
*F41B 5/12* (2006.01)

(52) U.S. Cl.
CPC . *F41B 5/105* (2013.01); *F41B 5/10* (2013.01); *F41B 5/123* (2013.01)

(58) Field of Classification Search
CPC ..... F41B 5/10; F41B 5/105; F41B 5/123
See application file for complete search history.

(56) References Cited

U.S. PATENT DOCUMENTS

| | | | | |
|---|---|---|---|---|
| D374,055 | S | 9/1996 | Strother | |
| 5,975,067 | A | 11/1999 | Strother | |
| 6,098,607 | A | 8/2000 | Strother | |
| 6,990,970 | B1 | 1/2006 | Darlington | |
| 6,994,079 | B1 | 2/2006 | Darlington | |
| 7,305,979 | B1 * | 12/2007 | Yehle | 124/25.6 |
| 7,997,259 | B2 | 8/2011 | Wilson | |
| 8,037,876 | B1 | 10/2011 | Yehle | |
| 8,082,910 | B1 | 12/2011 | Yehle | |
| 8,181,638 | B1 | 5/2012 | Yehle | |
| 8,205,607 | B1 | 6/2012 | Darlington | |
| 8,276,574 | B1 * | 10/2012 | Wilson | 124/25.6 |
| 8,469,013 | B1 | 6/2013 | Obteshka et al. | |
| 8,544,456 | B2 * | 10/2013 | Grace | 124/25.6 |
| 8,662,062 | B2 * | 3/2014 | Darlington | 124/25.6 |
| 8,720,425 | B2 * | 5/2014 | Strother | 124/25.6 |
| 2009/0255520 | A1 * | 10/2009 | Strother | 124/25.6 |
| 2010/0132682 | A1 | 6/2010 | Darlington | |
| 2010/0147276 | A1 | 6/2010 | Wilson et al. | |
| 2012/0000451 | A1 | 1/2012 | Grace | |
| 2013/0068206 | A1 * | 3/2013 | Langley | 124/25.6 |
| 2013/0074819 | A1 * | 3/2013 | McPherson | 124/25.6 |

* cited by examiner

*Primary Examiner* — John Ricci
(74) *Attorney, Agent, or Firm* — Reising Ethington PC

(57) ABSTRACT

A compound archery bow that includes: a bow handle, a limb projecting from the bow handle, and a pulley assembly coupled to the limb for rotation around an axis. The pulley assembly may be include a bowstring cam including a bowstring track in a bowstring plane, a let-out cam carried by the bowstring cam and including a let-out track in a let-out plane spaced apart from the bowstring plane, an arcuately-shaped first take-up cam arcuately adjustably coupled to the bowstring cam and including a first take-up track in a take-up plane, and a first draw stop at one end of the first take-up cam.

13 Claims, 6 Drawing Sheets

COMPOUND ARCHERY BOW WITH SYNCHRONIZED CAMS AND DRAW STOP

TECHNICAL FIELD

The present disclosure is directed to compound archery bows, including cross bows, having pulleys at the ends of the bow limbs to control the draw characteristics of the bow.

BACKGROUND AND SUMMARY OF THE DISCLOSURE

Single-cam and dual-cam archery bows have a power cam mounted on one or both ends of the bow limbs to control the draw force on the bowstring and the bending of the limbs as the bowstring is drawn. In single-cam bows, there is a power cam on one end of the one bow limb, and a wheel on the end of the other bow limb to facilitate control or take-up of a power cable at the power cam and let-out of the bowstring at the power cam as the bow is drawn. In dual-cam bows, power cams are mounted on the ends of both bow limbs. A problem can arise with bows that include synchronized dual cams having power cables anchored to the cams instead of the limbs. With this type of cam system, if the cam is allowed to be rotated too far, this can result in complete let-off of the draw force on the bowstring, thereby locking the cams at full draw with no tension on the bowstring.

A general object of the present disclosure is to provide a compound archery bow having a pulley assembly with a draw stop on a take-up cam that may be engaged against a power cable limiting rotation of the pulley at full draw, thereby preventing a cam-lock situation.

The present disclosure embodies a number of aspects that can be implemented separately from or in combination with each other.

In accordance with one aspect of the present disclosure, there is provided a compound archery bow that includes: a bow handle, a limb projecting from the bow handle, and a pulley assembly coupled to the limb for rotation around an axis. The pulley assembly may include a bowstring cam including a bowstring track in a bowstring plane, a let-out cam carried by the bowstring cam and including a let-out track in a let-out plane spaced apart from the bowstring plane, an arcuately-shaped first take-up cam arcuately adjustably coupled to the bowstring cam and including a first take-up track in a take-up plane, and a first draw stop at one end of the first take-up cam.

BRIEF DESCRIPTION OF THE DRAWINGS

The disclosure, together with additional objects, feature, advantages and aspects thereof, will best be understood from the following description, the appended claims and the accompanying drawings, in which:

DETAILED DESCRIPTION

Figure 1:
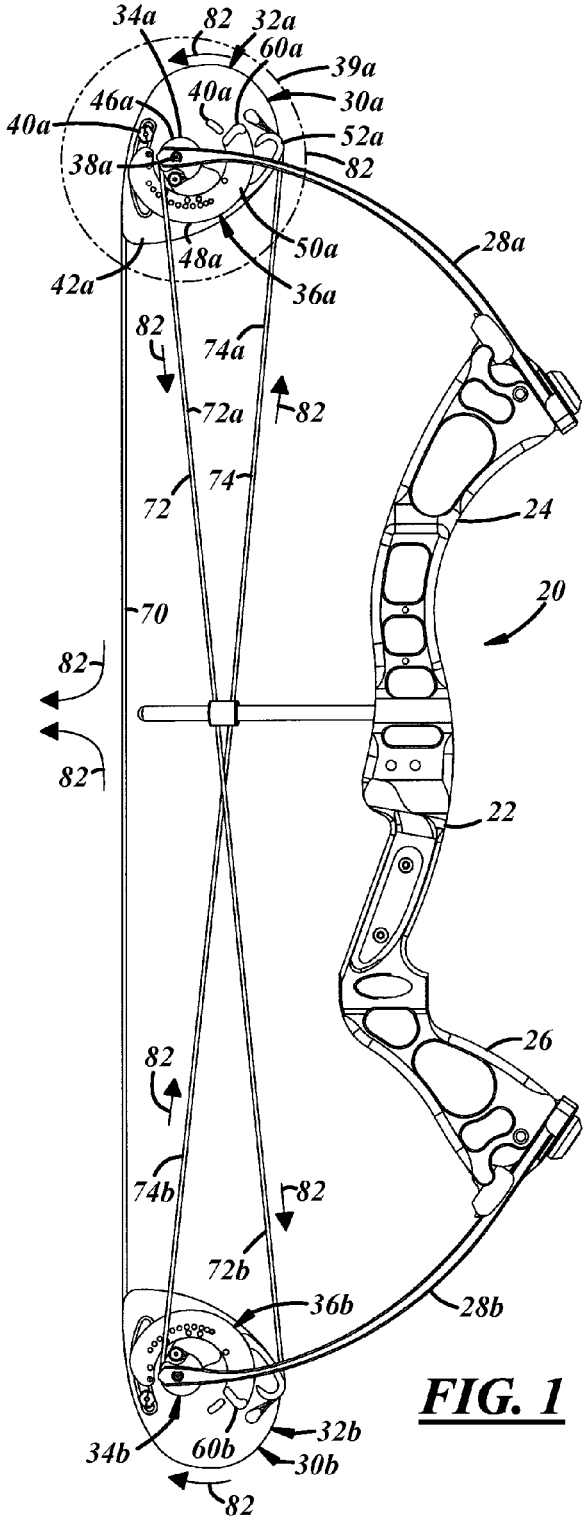
FIG. 1 is a side elevational view of a dual-cam archery bow in accordance with one illustrative embodiment of the present disclosure in a rest condition.

FIG. 1 illustrates a synchronized, dual-cam bow 20 in accordance with one illustrative embodiment of the present disclosure as including a handle 22 of aluminum or other relatively rigid construction having spaced risers 24, 26 with bow-mounting surfaces at the distal end of each riser. Each of the risers 24, 26 may carry a flexible resilient limb 28*a*, 28*b* of fiber-reinforced resin or other suitable resilient construction, and each limb may carry a pulley assembly 30*a*, 30*b* at a respective distal end. As upper and lower limbs 28*a*, 28*b* may be similar and as upper pulley 30*a* and lower pulley 30*b* may be similar, only one of each will be described below (reference numerals having an "a" being associated with the upper pulley assembly 30*a* and reference numerals having a "b" being associated with the lower pulley assembly 30*b*). As shown, upper and lower limbs 28*a*, 28*b* and upper and lower pulleys 30*a*, 30*b* may be mirror images of one other and function similarly.

The upper pulley assembly 30*a* may have several members including a bowstring cam 32*a*, a let-out cam 34*a*, and a take-up cam assembly 36*a*—the let-out cam 34*a* and take-up cam assembly 36*a* being carried by the bowstring cam 32*a*. The bowstring cam 32*a* may be coupled to and rotatable about an axle 38*a* at the distal end of the limb 28*a*.

Figure 4:
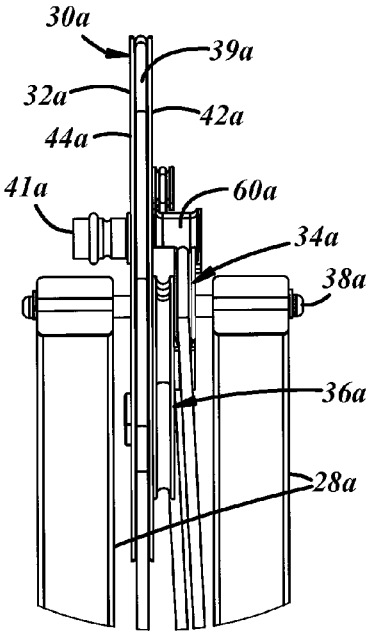
FIG. 4 is a fragmentary end elevational view of the bow of FIG. 1.

The bowstring cam 32*a* may have a bowstring let-out groove or track 39*a* extending around a periphery of the pulley assembly 30*a* (e.g., defined by the bowstring cam 32*a*) and a number of openings or voids 40*a* passing therethrough. Some of the voids 40*a* may be arcuately shaped slots or passages located at different radial distances from the axle 38*a*; other voids 40*a* may be merely circular or other suitably shaped through-holes or slots. For example, one of the arcuately-shaped voids 40*a* may carry a draw stop 41*a* (FIGS. 3 and 4) which may be fastened thereto and extend axially outwardly from either side of the bowstring cam 32*a*. As will be described in greater detail below, during rotation of the pulley assembly 30*a*, the draw stop 41*a* may engage the limb 28*a* to prevent over-rotation thereof.

Figure 2:
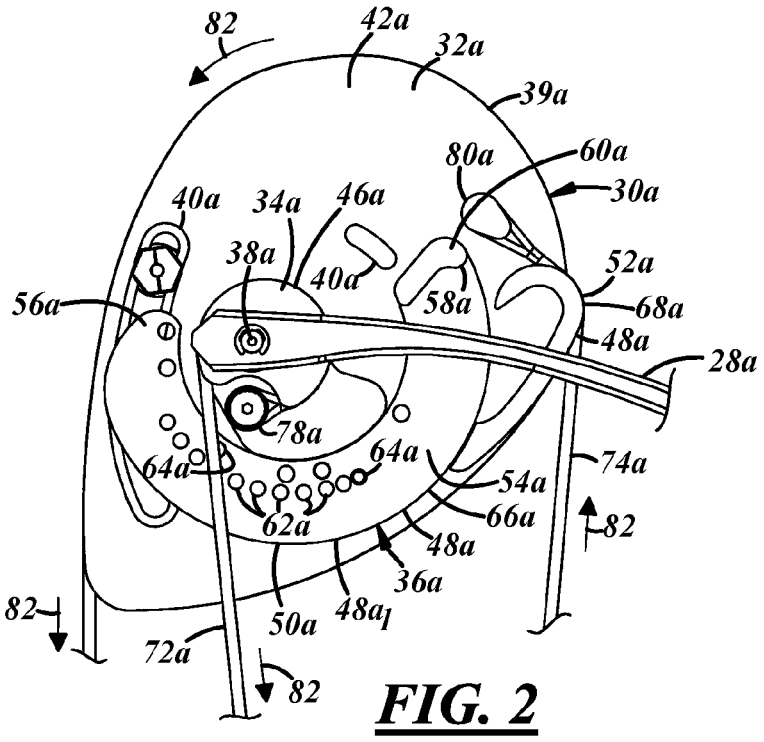
FIG. 2 is an enlarged, fragmentary view of one side of a pulley assembly shown in FIG. 1.

The let-out cam 34*a* also may be located at or near the axle 38*a*, and may be concentrically, or as shown in FIGS. 1 and 2, eccentrically carried by the axle 38*a*.

The let-out cam 34*a* and the take-up cam assembly 36*a* each may be axially spaced from the bowstring cam 32*a* (e.g., lying in different geometric planes or having different planar relationships). In the illustrations, the let-off cam 34*a* and take-up cam assembly 36*a* both are axially spaced from a first side 42*a* of the bowstring cam 32*a*; however, this is not required (e.g., both could be axially spaced from a second side 44*a* (see FIGS. 3 and 4), or one may be spaced from first side 42*a* and the other spaced from the second side 44*a*). The let out cam 34*a* and the take-up cam assembly 36*a* may have a let-out groove or track 46*a* and take-up groove or track 48*a*, respectively, extending at least partially around the respective peripheries thereof. In at least one embodiment, the take-up cam assembly 36*a* is axially spaced between the bowstring cam 32*a* and the let-out cam 34*a*.

The take-up cam assembly 36*a* may include a first take-up cam 50*a* and a second take-up cam 52*a* (best shown in FIG. 2). The first take-up cam 50*a* is illustrated as a portion or fragment of an annularly-shaped body 54*a* (e.g., an arcuate shape); however, any suitable shape may be used. The body 54*a* partially surrounds or circumscribes the axis 38*a* extending from a trailing end or edge 56*a* to a leading end or edge 58*a*. The leading edge 58*a* may have a draw stop 60*a* extending longitudinally therefrom. The width of the draw stop 60*a* may exceed the width (or thickness) of the take-up cam assembly 36*a*—thus also, the draw stop 60*a* may extend axially towards and/or away from the bowstring cam 32*a*.

The body 54*a* may have a plurality of cam stop adjustment holes 62*a* longitudinally spaced along at least a portion of the body 54*a*; e.g., the illustration shows two rows of holes 62*a* having different spacings therebetween. The locations and arrangement of the holes 62*a* may correspond with the length and configuration of one or more arcuate voids 40*a* in the bowstring cam 32*a* so that one or more fasteners 64*a* may detachably fix the take-up cam assembly 36*a* to the bowstring cam 32*a* (in FIGS. 2 and 3, two fasteners 64*a* are shown by way of example). Thus, collectively, the bowstring cam 32*a* and the take-up cam assembly 36*a* may be an adjustable module; e.g., configurable by a user of the bow 20.

The second take-up cam 52*a* may be an arm-like member extending from an outer periphery 66*a* of the first take-up cam body 54*a*. In FIG. 2, the second take-up cam 52*a* is shaped like a fishing hook; however, other shapes are possible. The take-up groove 48*a* may extend along at least a portion of the outer periphery 66*a* of the first take-up cam 50*a* (a first portion 480 and at least a portion of an outer periphery 68*a* of the second take-up cam 52*a* (along a second portion $48a_2$).

While the first and second take-up cams 50*a*, 52*a* have been described as separate components, in at least one implementation, cams 50*a*, 52*a* may be formed in a single or unitary, integral, and/or continuous piece.

The first and second pulley assemblies 30*a*, 30*b* may cooperate with one another via a bowstring cable 70, a first power cable 72, and a second power cable 74. In a rest or undrawn position or condition, the bowstring cable 70 may extend from a bowstring anchor 76*a* (see FIG. 3) coupled to the bowstring cam 32*a*, through the bowstring cam groove 39*a*, to and through the groove 39*b* on the bowstring cam 32*b*, and to bowstring anchor 76*b*. The first power cable 72 may extend from a first power cable anchor 78*a* coupled to the bowstring cam 32*a* (see FIG. 2), through the let-out cam groove 46*a*, to and through a portion of the groove 48*b* on the take-up cam assembly 36*b*, and to a second power cable anchor 80*b*. And the second power cable 74 may extend from the second power cable anchor 80*a* coupled to the bowstring cam 32*a*, through a portion of the take-up cam assembly groove 48*a*, to and through the groove 46*b* on the let-off cam 34*b*, and to the first power cable anchor 78*b*.

Figure 3:
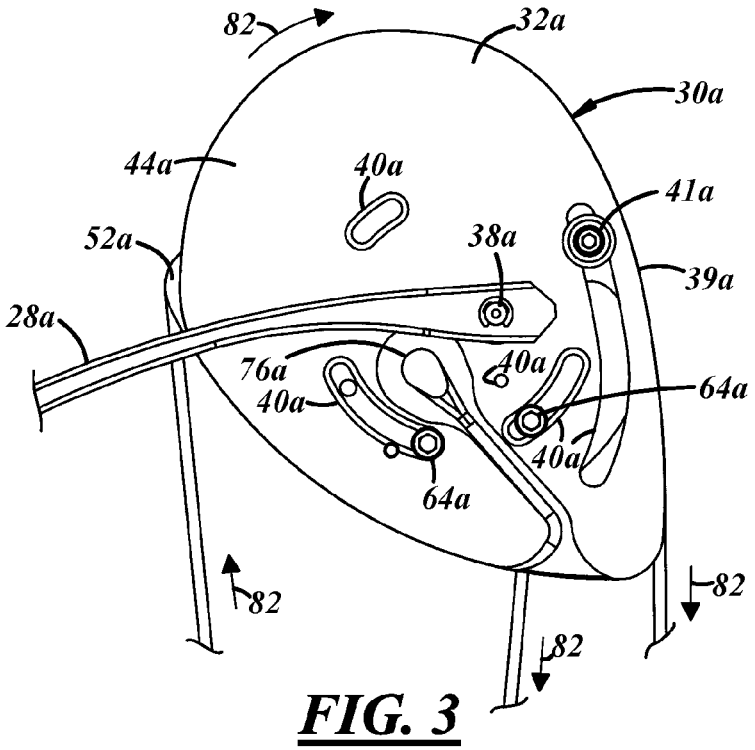
FIG. 3 is an enlarged, fragmentary view of the reverse side of the pulley assembly shown in FIG. 2.

The directional arrows 82 in FIGS. 1-3 illustrate the direction of movement of cables 70, 72 and 74, and of pulleys 30*a*, 30*b*, between the rest or undrawn condition of FIGS. 1-4 toward the fully drawn conditions of FIGS. 5-9 as bowstring 70 is drawn. As the bowstring 70 is drawn away from handle 22, pulleys 30*a*, 30*b* rotate (e.g., synchronously) in the directions 82 letting out power cable ends 72*a*, 74*b* and taking up power cable ends 74*a*, 72*b*.

Figure 5:
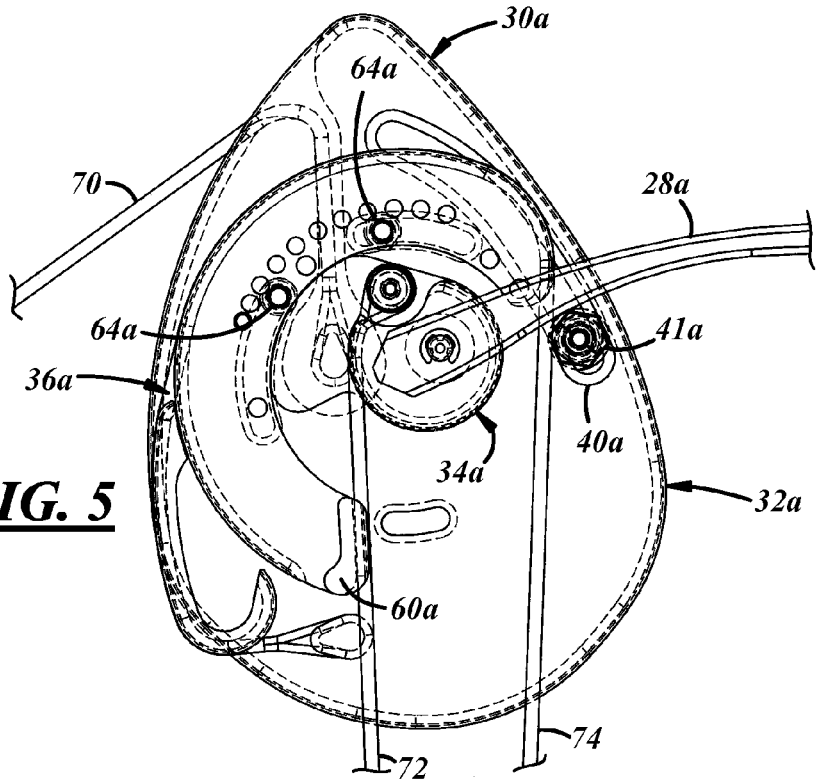
FIG. 5 is an enlarged, fragmentary view of a pulley assembly in a fully drawn condition with engagement of a draw stop with a power cable.

As shown in FIG. 5, in the fully drawn position or condition, only a portion of the grooves 46*a*, 46*b* of the let-off cams 34*a*, 34*b* may carry cables 72, 74, respectively. Similarly, in the fully drawn condition, all or a majority of the grooves 48*a*, 48*b* of the take-up cam assemblies 36*a*, 36*b* may carry cables 74, 72, respectively. Also, the draw stop 60*a* at the take-up cam assembly leading edge 58*a* may abut the power cable 72 (e.g., at end 72*a*). In addition, the draw stop 41*a* may abut the limb 28*a*.

The draw stop 60*a* or 41*a* may inhibit the cable 70 from being overdrawn and entering a cam-lock position or condition. Synchronized cam systems can achieve 100% let-off if there is not some means for limiting cam rotation. For example, when cams rotate beyond 100% let-off, the bow may enter the cam-lock condition having no tension on the bowstring cable 70 and all the tension in the power cables 72, 74. This position can be undesirable and may require proper tools to correct the situation. As will be appreciated by those of ordinary skill in the art, a cam-lock condition may require placing the bow 20 into a bow press and compressing the limbs 28*a*, 28*b* to release the tension on the cables 72, 74. Thereafter, the limbs 28*a*, 28*b* may be relaxed and the bow 20 may be reassembled.

Prevention of a cam-lock condition may be implemented in several ways. For example, cam rotation may be limited by using a draw stop (e.g., stop 41*a*) located on or near the outer perimeter of a cam that makes contact with its supporting limb. If the stop is not adjustable, it may be configured to limit the cam to one draw length. However, if the stop is adjustable (as shown in FIG. 3), cam-lock prevention requires the user to correctly position the stop to limit the cam to one draw length; i.e., it may be possible to incorrectly position the stop and thereby enable a cam-lock condition when the bow is drawn beyond 100% let-off.

Another way to prevent cam-lock is to incorporate a draw stop in the take-up groove of each cam to limit the rotation. For example, the take-up groove may be extended to cause the draw weight to increase once the desired draw length is achieved. Thus, the cam rotation may be limited to one draw length—e.g., if the bow does not use adjustable draw modules. However, if the module is adjustable (as shown in FIG. 3), as will be appreciated by those of ordinary skill in the art, it may be difficult to calibrate a desirable let-off at all draw lengths, and this may increase the likelihood of a cam-lock condition. When using synchronized cams with only two grooves, it may not be possible to extend the take-up groove of a draw stop.

And yet another way to prevent the cam-lock condition (unique to synchronized cams) may be to limit the rotation of the cams by limiting the feed out of the power cable by attaching a stop to the base of the cam.

It will be appreciated that cam-lock conditions apply to both vertically-oriented bows (e.g., as shown in FIG. 1) as well as crossbows. For example, when cocking a crossbow, it may be desirable to overdraw the bowstring cable (e.g., beyond what is required for the power stroke) to enable the bowstring cable to latch in its receiver. When the bowstring cable is gripped (e.g., by the user or a cocking aid), additional bowstring cable may be used. The cams may be suitably configured to enable extra draw length, making it easier for the user to cock the crossbow.

Returning to FIG. 5, the present disclosure provides the draw stop 60*a* which may engage the bowstring cable 70 at full draw regardless of whether the draw stop 41*a* is positioned incorrectly (e.g., if stop 41*a* is positioned beyond full draw, allowing more than 100% let-off). Further, the draw stop 60*a* is feasible in both vertically-oriented bows and, as will be explained below, in crossbows.

Figure 6:
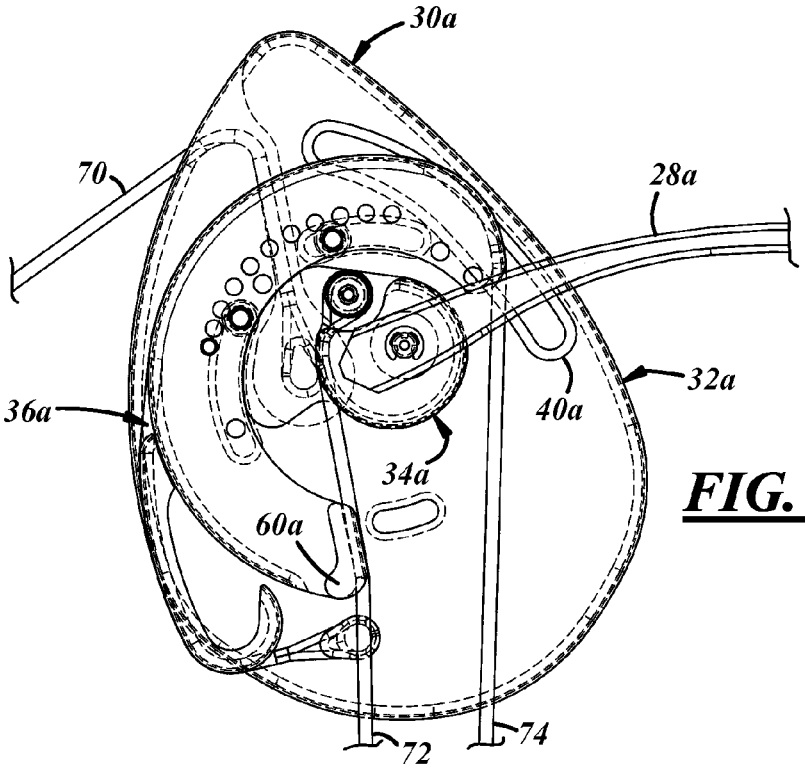
FIG. 6 is an enlarged, fragmentary view of the pulley assembly of FIG. 5 in an overdrawn condition.

FIG. 6 illustrates that the draw stop 60*a* may inhibit a cam lock condition even in the event that the draw stop 41*a* is absent. For example, while additional force may be applied to the cable 72 by the draw stop 60*a* causing it to flex as shown (e.g., displacing it approximately 0.5-1.0 inches); this additional application also may be insufficient to place the bow 20 into the cam lock condition.

Figure 7:
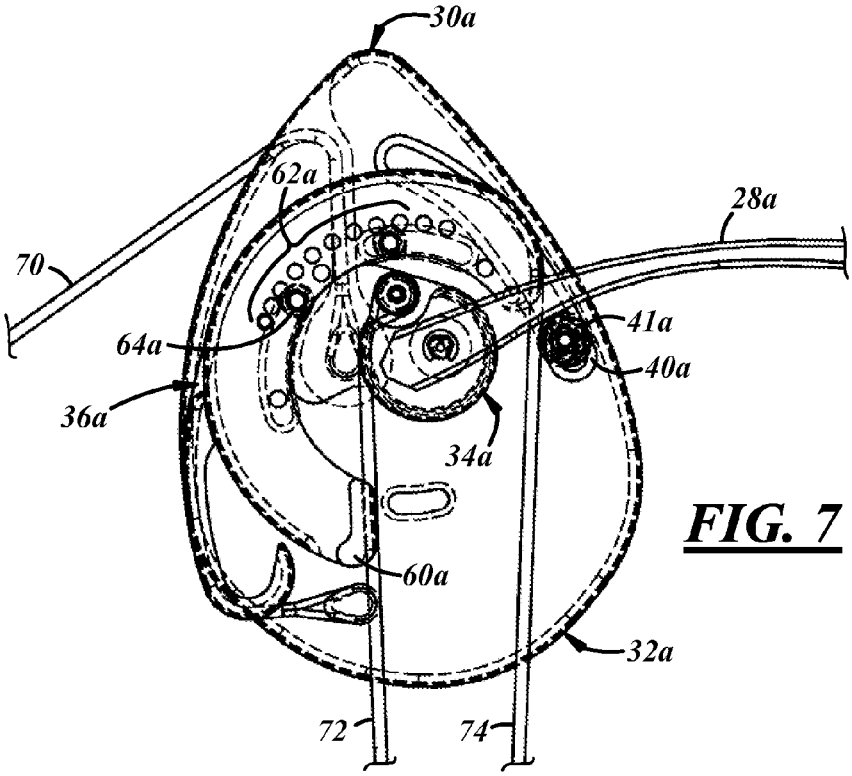
FIG. 7 is an enlarged, fragmentary view of the pulley assembly in a fully drawn condition in a first module adjustment position.
Figure 8:
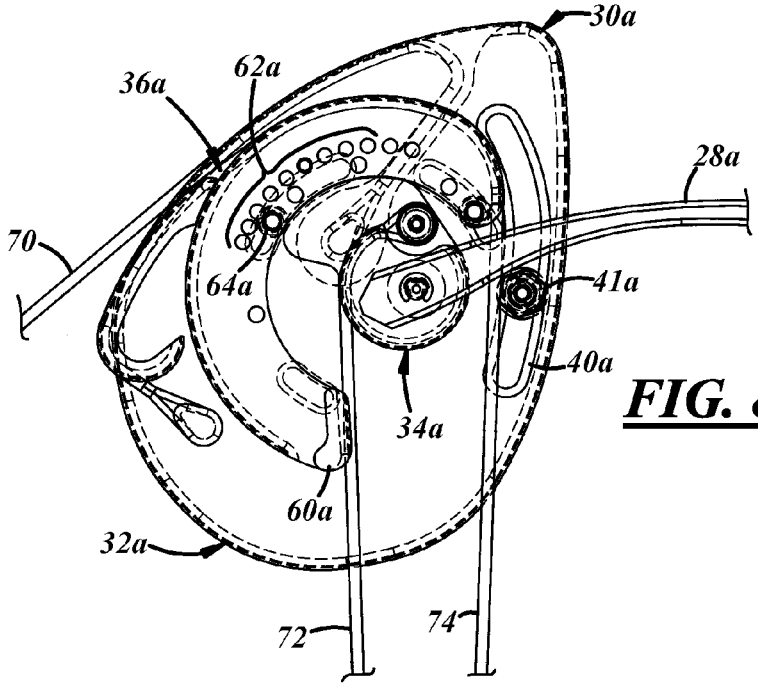
FIG. 8 is enlarged, fragmentary view of the pulley assembly in a fully drawn condition in a second module adjustment position.
Figure 9:
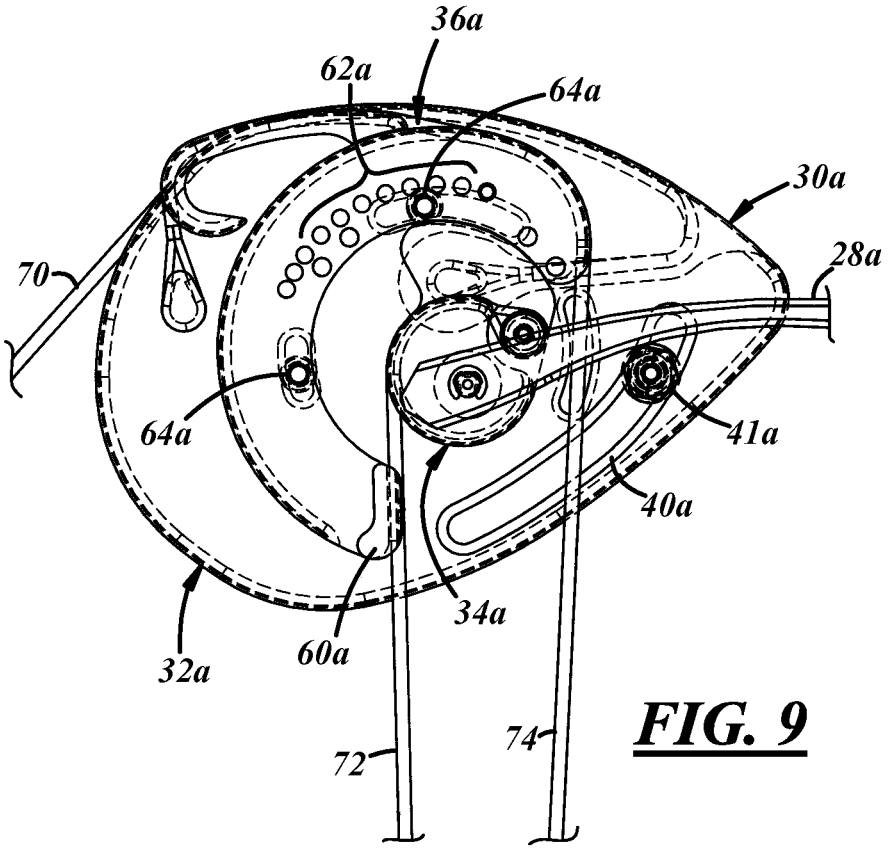
FIG. 9 is enlarged, fragmentary view of the pulley assembly in a fully drawn condition in a third module adjustment position.

FIGS. 7, 8, and 9 illustrate that the take-up cam assembly 36*a* may be detachably fixed in various locations using the holes 62*a* and fasteners 64*a* and that the draw stop 41*a* may be detachably fixed at various locations in one of the arcuate voids 40*a* so that in the fully drawn condition, the stop 41*a* abuts the limb 28*a* and the stop 60*a* abuts the cable 72. Thus, depending on the holes 62*a* and voids 40*a* used, the effective draw length of the bow 20 may be delineated or predefined.

Figure 10:
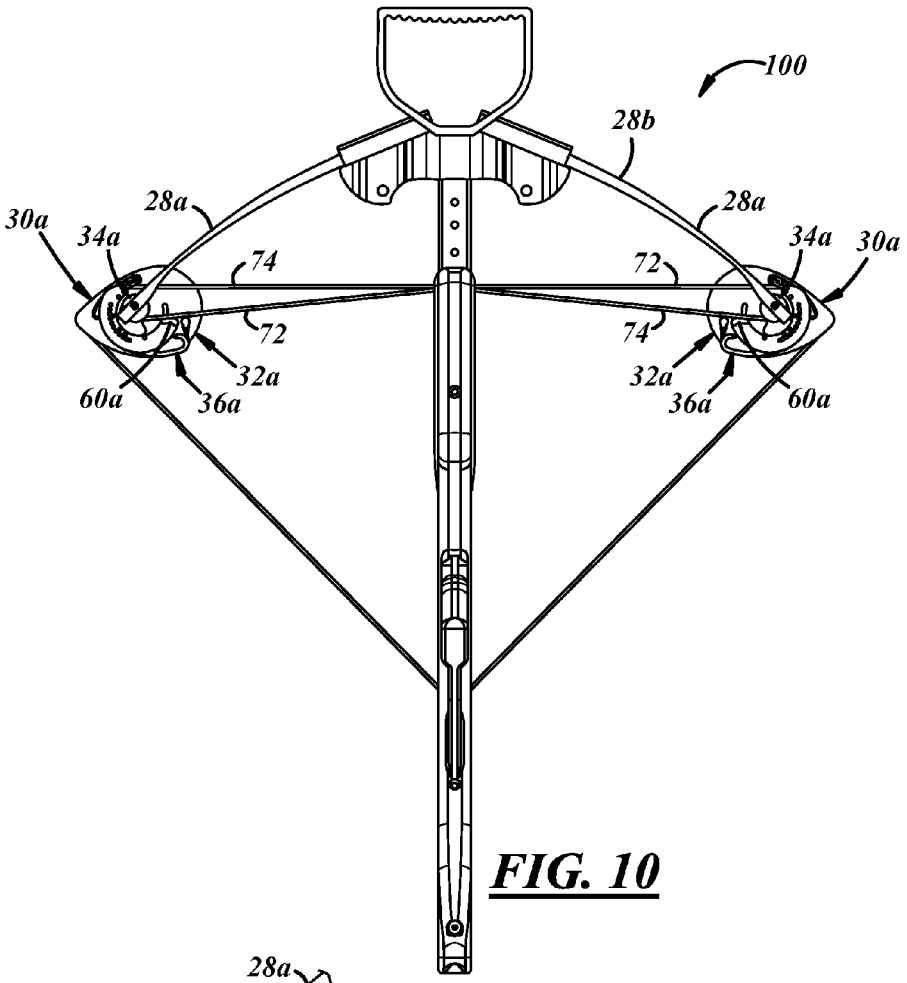
FIG. 10 is a bottom plan view of a crossbow in accordance with a second illustrative embodiment of the present disclosure in a fully drawn condition.
Figure 11:
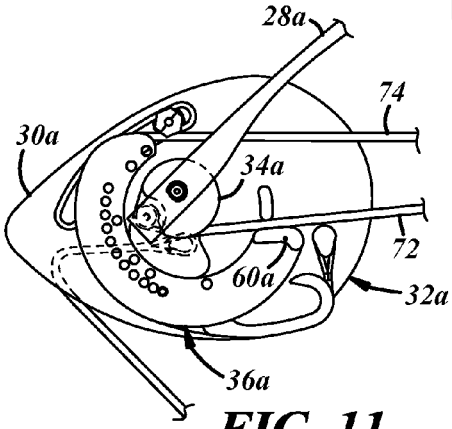
FIG. 11 is an enlarged view of one of the pulley assemblies of FIG. 10.
Figure 12:
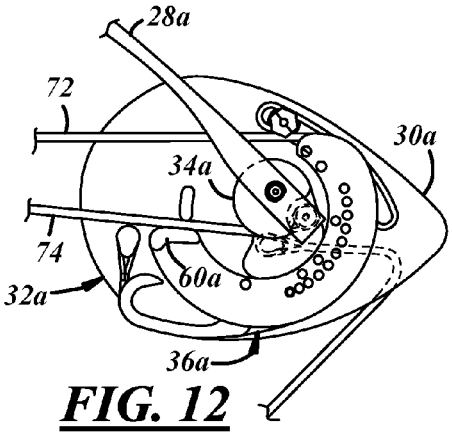
FIG. 12 is an enlarged view of the other of the pulley assemblies of FIG. 10.

FIGS. 10-12 illustrate a crossbow 100 embodying the principles of the present disclosure. Elements similar in function to those described above in connection with FIGS. 1-9 are indicated by correspondingly identical reference numerals.

Pulleys 30*a*, 30*b* can be of any suitable construction; in addition, the shapes of the cams may vary. For example, while the bowstring cam is shown as having a guitar-pick shape, it may be circular or non-circular. Similarly, the let-off cams 34*a*, 34*b* and the take-up cam assemblies 36*a*, 36*b* may be any suitable shape.

In addition, although the holes 62*a* are shown on take-up cam assembly 36*a* and the voids 40*a* are shown on the bowstring cam 32*a*, the holes 62*a* may be located on the cam 32*a* and the voids 40*a* may be located on the assembly 36*a*.

There thus has been disclosed an archery bow that fully satisfies all of the objects and aims previously set forth. The bow has been disclosed in conjunction with illustrative embodiments, and modifications and variations have been discussed. Other modifications and variations readily will suggest themselves to persons of ordinary skill in the art in view of the foregoing description. The disclosure is intended to embrace all such modifications and variations as fall within the spirit and broad scope of the appended claims.

The invention claimed is:

1. A compound archery bow that includes:
- a bow handle;
- a limb projecting from the bow handle; and
- a pulley assembly coupled to the limb for rotation around an axis, and including:
  - a bowstring cam including a bowstring track in a bowstring plane,
  - a let-out cam carried by the bowstring cam and including a let-out track in a let-out plane spaced apart from the bowstring plane,
  - an arcuately-shaped first take-up cam arcuately adjustably coupled to the bowstring cam and including a first take-up track in a take-up plane, and
  - a first draw stop at one end of the first take-up cam.

2. The bow set forth in claim 1, wherein the pulley assembly includes a second take-up cam carried by the bowstring cam that includes a second take-up track in the take-up plane.

3. The bow set forth in claim 2, wherein the first and second take-up planes are spaced between the bowstring and let-out planes.

4. The bow set forth in claim 2, wherein the first and second take-up tracks share the same plane.

5. The bow set forth in claim 2, that also includes:
- a bowstring cable extending from a bowstring anchor through the bowstring let-out track;
- a first power cable extending from a first power cable anchor through the let-out track of the let-out cam; and
- a second power cable extending from a second power cable anchor through the first take-up track of the first take-up cam in a rest state of the bow, and also extending through the second take-up track of the second take-up cam in a draw state of the bow,
- wherein draw of the bowstring cable away from the handle lets out bowstring cable from the bowstring track, rotates the pulley assembly around the axis, lets out the first power cable from the let-out track, takes up the second power cable in the first and second take-up tracks, and engages the first draw stop at the first power cable to inhibit further rotation of the pulley assembly and draw of the bowstring cable, thereby defining a fully drawn position of the bowstring cable and the pulley assembly.

6. The bow set forth in claim 1, wherein at least one of the bowstring cam or the first take-up cam includes one or more arcuate slots sized to receive a fastener and the other of the bowstring cam or the first take-up cam includes corresponding holes sized to receive the fastener to adjustably couple the first take-up cam to the bowstring cam.

7. The bow set forth in claim 6, wherein a position of the fastener within the length of the one or more slots and through one of the holes delineates an effective draw length of the bow.

8. The bow set forth in claim 6, wherein at least two fasteners couple the first take-up cam to the bowstring cam.

9. The bow set forth in claim 6, wherein the first draw stop is located on a first side of the bowstring cam and arranged to rotatably interfere with one of a plurality of cables of the bow, wherein the bow further comprises a second draw stop extending axially outwardly of a second side of the bowstring cam carried by one of the arcuate slots, wherein the second draw stop is arranged to rotatably interfere with the limb.

10. The bow set forth in claim 9, wherein the first draw stop rotatably interferes with a first power cable carried by the let-out cam to inhibit an overdraw condition regardless of the position of the second draw stop in the one of the arcuate slots.

11. The bow set forth in claim 6, wherein the at least one of the bowstring cam or the first take-up cam includes three arcuate slots.

12. The bow set forth in claim 1, wherein the bow is a vertical bow, wherein the bow handle and limb extend vertically.

13. The bow set forth in claim 1, wherein the bow is a crossbow.

* * * * *